US009404400B2

(12) United States Patent
Slot et al.

(10) Patent No.: US 9,404,400 B2
(45) Date of Patent: Aug. 2, 2016

(54) CYLINDER HEAD WITH VALVE SEAT AND METHOD FOR THE PRODUCTION THEREOF

(75) Inventors: Hendrik Marcel Slot, Best (NL); Sebastiaan Maria Krosse, Belfeld (NL); Johannes Petruz Zijp, Oisterwijk (NL)

(73) Assignee: DAF TRUCKS N.V., Eindhoven (NL)

( * ) Notice: Subject to any disclaimer, the term of this patent is extended or adjusted under 35 U.S.C. 154(b) by 718 days.

(21) Appl. No.: 13/056,929

(22) PCT Filed: Aug. 3, 2009

(86) PCT No.: PCT/NL2009/050477

§ 371 (c)(1),
(2), (4) Date: Jun. 24, 2011

(87) PCT Pub. No.: WO2010/014012

PCT Pub. Date: Feb. 4, 2010

(65) Prior Publication Data

US 2011/0239858 A1 Oct. 6, 2011

(30) Foreign Application Priority Data

Aug. 1, 2008 (NL) ..... 2001869

(51) Int. Cl.
*F02F 3/00* (2006.01)
*F02F 11/00* (2006.01)
(Continued)

(52) U.S. Cl.
CPC ... *F01L 3/04* (2013.01); *F02B 3/06* (2013.01); *F02B 2075/025* (2013.01); *F02F 3/00* (2013.01); *F05C 2201/021* (2013.01); *F05C 2201/0448* (2013.01)

(58) Field of Classification Search
CPC ..... F02B 2075/025; F02B 3/06; F02F 3/00; F05C 2201/021; F05C 2201/0448
USPC ..... 123/193.1, 193.3, 193.5
See application file for complete search history.

(56) References Cited

U.S. PATENT DOCUMENTS 3,170,452 A * 2/1965 Dobovan ..... 123/188.8
3,421,886 A * 1/1969 Schelleng ..... 420/22
(Continued)

FOREIGN PATENT DOCUMENTS

DE 101 56 196 1/2003
DE 101 51 716 5/2003
(Continued)

OTHER PUBLICATIONS

X He, Temperature and composition profile during double-track laser cladding of H13 tool steel, Dec. 7, 2009, IOP Publishing, Journal of Physics D: Applied Physics, 1-9, stacks.iop.org/JPhysD/43/015502 (Laser Cladding—for short).*
(Continued)

*Primary Examiner* — Lindsay Low
*Assistant Examiner* — Charles Brauch
(74) *Attorney, Agent, or Firm* — Banner & Witcoff, Ltd.

(57) ABSTRACT

Cylinder head made of cast iron has valve seats provided therein. The valve seats include an annular bore provided in the cast-iron material, a nickel-based intermediate layer which is provided thereon and a contact layer which is provided on said intermediate layer. The contact layer has an air-hardening tool steel, wherein said layers are provided in such a manner that an annularly acting compressive stress is present near the free surface of said contact layer. The invention further includes a method for the production thereof.

20 Claims, 3 Drawing Sheets

Figure 1:
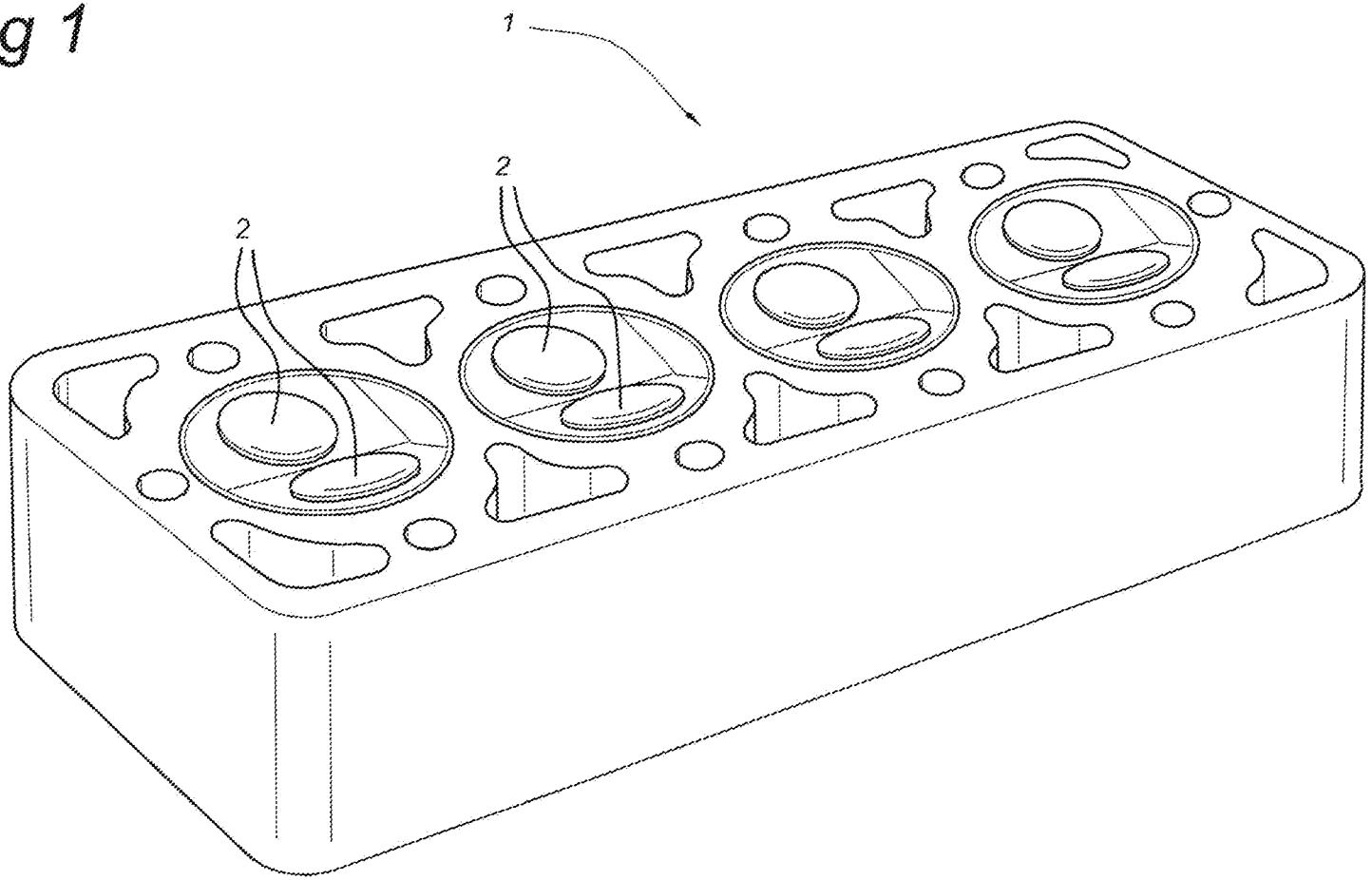

(51) Int. Cl.

| | |
|---|---|
| ***F02F 1/42*** | (2006.01) |
| ***F01L 3/04*** | (2006.01) |
| *F02B 3/06* | (2006.01) |
| *F02B 75/02* | (2006.01) |

(56) References Cited

U.S. PATENT DOCUMENTS

| | | | | |
|---|---|---|---|---|
| 3,535,765 | A * | 10/1970 | Denehie | 29/888.42 |
| 4,546,737 | A * | 10/1985 | Kazuoka et al. | 123/188.8 |
| 5,787,853 | A * | 8/1998 | Adachi et al. | 123/193.5 |
| 5,860,401 | A * | 1/1999 | Adachi et al. | 123/188.8 |
| 6,170,444 | B1 * | 1/2001 | Ohlmann | 123/69 V |
| 2003/0177863 | A1 * | 9/2003 | Koyama | 75/241 |
| 2004/0251242 | A1 * | 12/2004 | Suh | 219/121.63 |
| 2005/0034700 | A1 * | 2/2005 | Clause et al. | 123/188.8 |
| 2005/0132843 | A1 * | 6/2005 | Jiang et al. | 75/252 |
| 2007/0086910 | A1 * | 4/2007 | Liang | 420/12 |
| 2007/0131803 | A1 * | 6/2007 | Phadke | 239/585.1 |
| 2008/0253918 | A1 * | 10/2008 | Liang | 420/12 |
| 2009/0032501 | A1 * | 2/2009 | Swingley et al. | 219/76.12 |
| 2009/0151163 | A1 * | 6/2009 | Kawasaki et al. | 29/888.06 |

FOREIGN PATENT DOCUMENTS

| | | |
|---|---|---|
| EP | 0 915 184 | 5/1999 |
| GB | 561 587 | 5/1944 |
| GB | 618 607 | 2/1949 |

OTHER PUBLICATIONS (Vanadis Reference) Better Combustion with the Right Valve Seats Vanadis 23, Jan. 11, 2005, p. 1.*

X He, Transport phenomena during direct metal deposition, Mar. 15, 2007, AIP publishing, Journal of Applied Physics 101, 053113 (2007); doi: 10.1063/1.2710780 (Laser Cladding 2).*

Esab AB, Repair and Maintenance Welding Handbook, May 8, 2006, Esab AB, Second Edition, pp. 10-40.*

* cited by examiner

CYLINDER HEAD WITH VALVE SEAT AND METHOD FOR THE PRODUCTION THEREOF

The present invention relates to a cylinder head made of cast iron with valve seats provided therein.

A cylinder head of this type is generally known in the prior art.

An annular chamber is milled out at the location of the intended valve seat and subsequently a valve seat which is made from a special material is arranged therein. The material used has the properties which are required for repeated contact with the continuously closing valve. These are tribologic properties, such as resistance to abrasion, adhesion and tribochemical damage, fatigue properties, and other strength properties which, moreover, have to be maintained at high temperature. Depending on the fuel used, these mechanical requirements increase further. In general, cast iron does not have these mechanical properties, so that it is necessary to provide such a valve seat in the form of a ring.

Providing such rings is labour-intensive. In addition, this ring takes up valuable space. A significant load on the cylinder head is the so-called ThermoMechanical Fatigue (TMF), which is closely linked to the maximum temperature of the cylinder head. In order to lower the thermal load on the material around the inlet and the outlet, cooling ducts are positioned as close as possible to the surface of the cylinder head. However, as a result of the milled-out space for the valve seat, the distance of these cooling ducts from the surface is greater than is desirable and the load on the material of the cylinder head increases.

In addition, there is a heat resistance between the valve seat which has been pressed in and the milled-out chamber of the cylinder head as a result of a limited gap (on a microscale) between both bodies, which limits the heat dissipation to the cylinder head.

Conversely, the need to provide a valve seat in milled-out chambers results in a reduced diameter of the inlet and outlet ducts. This reduced diameter of the inlet and outlet ducts results in a reduced efficiency of the motor, since the supply and discharge of combustion gases is rendered more difficult.

It is known, in particular for lighter engines, such as petrol engines and diesel engines in passenger cars, to use aluminium as the material for the cylinder heads. Since aluminium does not at all have the required mechanical properties for valve seats, rings made of special material are always used therein. In order to reduce the efforts associated therewith, it is proposed, for example in DE 10151716 A1, to provide a coating layer directly on top of the aluminium by cladding. It has been found that this results in particularly severe problems which are due to, in particular, the different coefficients of thermal expansion between the applied layer and the aluminium. However, such a problem also occurs when providing valve seats in an aluminium cylinder head.

GB 561587 discloses a cylinder head made of cast iron in which valve seats have been provided, which valve seats comprise an annular bore, an intermediate layer provided thereon and a contact layer provided on said intermediate layer.

GB 618607 describes the use of an intermediate layer based on nickel for a different application.

It is an object of the present invention to provide a cylinder head made of castiron material with a valve seat which has improved mechanical properties and which valve seat can be provided in a simple manner and the expected service life of which is significantly longer than the service life of combinations of cast-iron cylinder head and valve seat known from the prior art.

This object is achieved with a cast-iron cylinder head which comprises a valve seat provided therein, said valve seat comprising an annular bore provided in the cast-iron material, a nickel-based intermediate layer which is provided thereon and a contact layer which is provided on said intermediate layer, said contact layer comprising an airhardening tool steel, wherein said layers are provided in such a manner that an annularly acting compressive stress is present near the free surface of said contact layer.

The cast iron used for the cylinder head is preferably vermicular cast iron. By using such cast-iron materials, the fatigue strength is greatly increased.

It has been found that if an air-hardening tool steel is applied as a layer, and more particularly as a contact layer, for a valve seat, such a material assumes a "hard" structure upon application. This will generally be a martensitic structure. In this case, the term contact layer is understood to mean the layer which is in contact with the closing valve.

It has been found that as a result of this application method, compression occurs in the material of the contact layer due to phase transformation. This compressive stress prevents the formation of cracks in the contact layer which, on the one hand, prevents leaking and, on the other hand, counteracts the effects of fatigue. When the valve touches the contact layer, this force is mainly absorbed by the compressive stress and any tensile load can be limited to a great extent.

The fatigue load to which a valve seat and more particularly the contact layer is subjected has to be distinguished from the load of said two surfaces sliding along one another. In the latter case, wear layers are used which consist of stellite and the like. Such a load of mutually reciprocating palts does not result in the fatigue load which occurs when a valve continuously touches a valve seat. This becomes clear if any cracks form in a surface layer. These have no effect in the case of the two parts which slide along one another and can even function to accommodate lubricant. However, with the contact load such as occurs between the valve and valve seats, such cracks are not permissible, as they indicate the start of the valve seat fracturing and, in addition, are the start of a leak trail, resulting in a further increase in erosion.

The expression air-hardening tool steel is understood to mean a type of steel which comprises substantially iron to which carbon, chromium and molybdenum have been added. If desired, elements such as cobalt, tungsten, vanadium, silicon and manganese may be present.

Preferably, the above-described layers are applied by cladding and more particularly by laser cladding or PTAW cladding (Plasma Transfer Arc Welding) of both the intermediate layer and the contact layer, preferably supplied in powder form, requirements obviously being imposed with regard to the material properties such as grain size and the like. Air-hardening tool steels which achieve good results are known by the brand names Vanadis® and Micromelt®, in particular types 23 and 30. However, it should be understood that other air-hardening tool steels can be used with the present invention with satisfactory results.

Examples are tool steels with the following properties:

Steel with a total of less than 30% alloying elements of Mn, Cr, Mo, W, V and Co, In powder form or as wire, A cooling rate, $\Delta_{800\text{-}500}>500$ s, resulting in a hardness of at least 650 HV (Vickers hardness) due to martensite formation. The expression $\Delta_{800\text{-}500}>500$ s is understood to mean a cooling time of more than 500 seconds in the range from 800° C.

to 500° C. That is to say that cooling times which are shorter than 500 s should always result in a hardness of at least at least 650 HV.

The intermediate layer is in particular present to keep the composition of the contact layer as constant as possible and, more particularly, to prevent the migration of alloying elements from the contact layer in the cast iron and migration of in particular carbon from the cast iron to the contact layer. An alloy with a high nickel percentage (more than 40%) works particularly well. Inconel is an example thereof.

The above-described compressive stress in the contact layer and more particularly near the free end thereof which comes into contact with the valve is preferably 200-600 MPa.

The thickness of the intermediate layer is preferably at least 0.2 mm. The thickness of the intermediate layer is measured between the fusion line of the intermediate layer with the cast iron and the fusion line of the intermediate layer with the contact layer. The contact layer has a thickness of at least 1 mm. However, this will in general be slightly thicker because, after the application of the contact layer, a final machining treatment thereof takes place in order to give the valve seat its final shape. More particularly, the contact layer may be composed of two layers, the composition of which may either be the same or slightly different from one another.

After the various layers have been applied in a previously provided bore in the cylinder head, the cylinder head is still flattened, thus exposing the intermediate layer at the head surface. By way of example, a total layer thickness for machining of approximately 2-3 mm is mentioned, which includes the thickness of the intermediate layer and the contact layer.

The invention furthermore relates to a method of providing a valve seat in a cylinder head, comprising providing an annular bore, providing a nickel-based intermediate layer in said bore by, starting from a powder and/or wire, depositing this by means of an energy beam from a welding source, followed by the application of a contact layer, comprising depositing the latter, starting from a powder air-hardening tool steel, by means of an energy beam from a welding source on an intermediate layer.

In particular, in this case, a cooling rate of at most 500 seconds is maintained in the range between 800 and 500° C.

The term energy beam from a welding source is here understood to mean inter alia a welding arc or a laser beam.

Figure 2A:
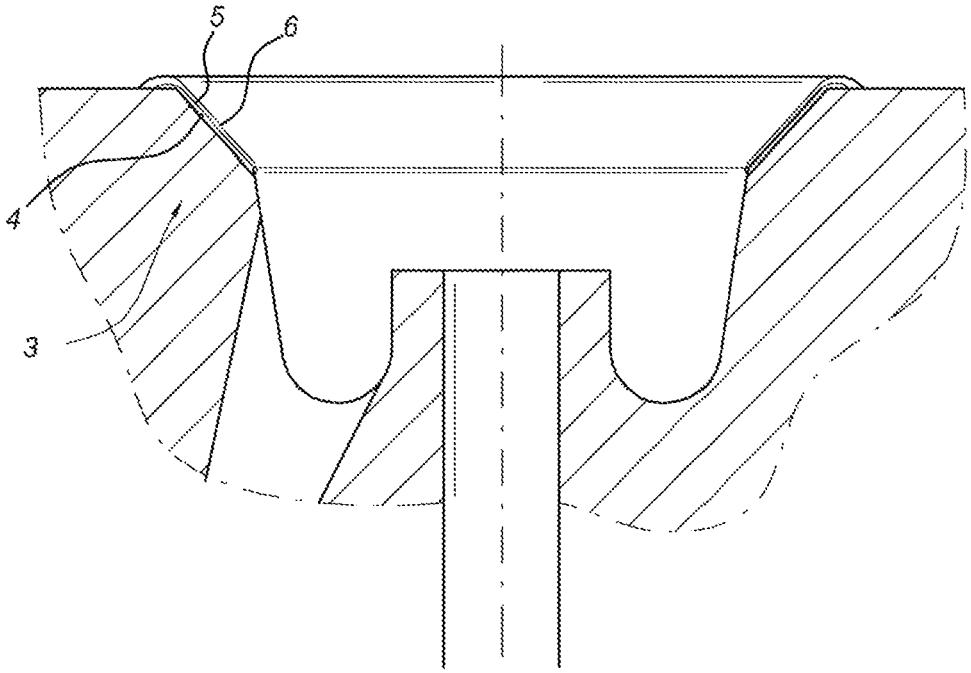
Figure 2B:
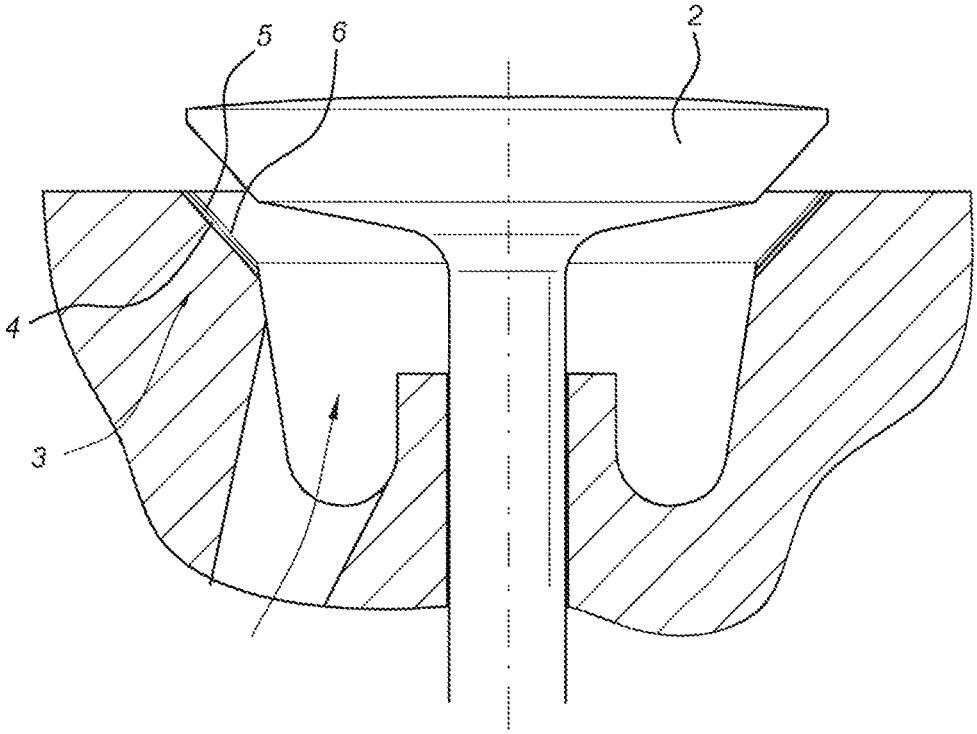
Figure 3A:
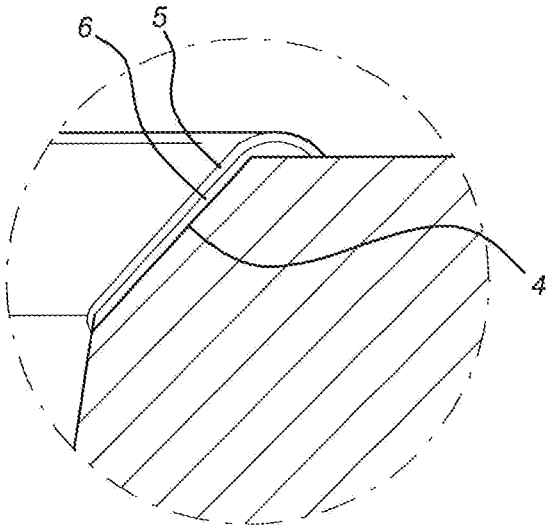
Figure 3B:
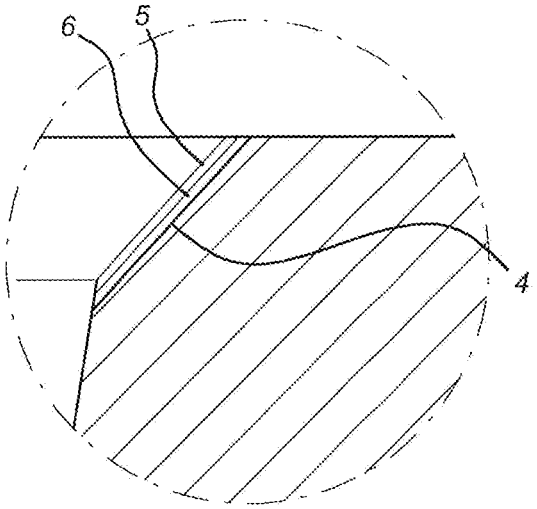

The invention will be explained in more detail below with reference to an exemplary embodiment which is illustrated diagrammatically in the drawing, in which:

FIG. 1 diagrammatically shows a cast-iron cylinder head;

FIGS. 2*a*-2*b* show details of the valve seat which is provided therein in the various production stages thereof;

FIGS. 3*a*-3*b* show details of FIG. 2*a* and FIG. 2*b*, respectively.

In FIG. 1, reference numeral 1 denotes a cylinder head of, in the present case, a four-cylinder engine.

It will be understood that the present invention can be used with any number of cylinders. In every combustion chamber, there are two valves which are denoted by reference numeral 2. Here as well, it will be understood that the number of valves may vary, as circumstances require.

FIG. 2*a* shows a detail of a valve seat. The valve seat, an annular bore which has been machined slightly after the casting process, is denoted by reference numeral 3. According to the present invention, an intermediate layer 4, for example a layer of nickel, is first applied thereto by means of laser cladding. Thereafter, a first Vanadis layer 5 is applied, followed by a second Vanadis layer 6. These Vanadis layers may comprise Vanadis 30, but preferably comprise Vanadis 23. After these layers have been applied, the cylinder head is still flattened, resulting in the structure illustrated in FIG. 2*b*, which also shows a valve 2 for the sake of clarity. It is clear that, after the processing step, the intermediate layer 4 is no longer covered by the contact layer and is exposed at the end which is directed towards the interior of the combustion chamber.

The composition of the Vanadis material is as follows:

| | Approximate composition (% by weight) | | | | | | | | | |
|---|---|---|---|---|---|---|---|---|---|---|
| Material | Fe | C | Cr | Mo | Ni | Co | W | V | Si | Mn | Cu |
| Vanadis 23 | Bal | 1.28 | 4.2 | 5.0 | — | — | 6.4 | 3.1 | — | — | — |
| Vanadis 30 | Bal | 1.28 | 4.2 | 5.0 | — | 8.5 | 6.4 | 3.1 | — | — | — |

What is claimed is:

1. Cylinder head made of cast iron, comprising:

a combustion chamber;

a valve seat provided in the combustion chamber, said valve seat comprising:

an annular bore provided in the cast-iron material;

a nickel-based intermediate layer which is provided in said bore; and a contact layer which is provided on said intermediate layer, said contact layer comprising an air-hardening tool steel, wherein said layers are provided in such a manner that an annularly acting compressive stress is present near the free surface of said contact layer;

wherein the valve seat is provided by deposition of the nickel-based intermediate layer and the contact layer by welding, and wherein the intermediate layer at an end thereof directed towards the combustion chamber is exposed by flattening of the cylinder head after application of the intermediate and contact layers.

2. Cylinder head according to claim 1, wherein said intermediate layer has a thickness of at least 0.2 mm.

3. Cylinder head according to claim 1, wherein said contact layer has a thickness of at least 0.5 mm.

4. Cylinder head according to claim 1, wherein said contact layer comprises two sublayers which have been arranged on top of one another.

5. Cylinder head according to claim 1, wherein said intermediate layer comprises a nickel-containing layer containing at least 40% nickel.

6. Cylinder head according to claim 1, wherein the contact layer comprises an air-hardening tool steel containing less than 30% by weight of alloying elements of Mn, Cr, Mo, W, V and Co and having a hardness of at least 650 HV.

7. Cylinder head according to claim 1, wherein said layer comprises a fused powder material.

8. Cylinder head according to claim 1, wherein said intermediate layer is exposed near the end boundary of said valve seat.

9. Cylinder head according to claim 1, wherein said contact layer comprises a martensitic structure.

10. Cylinder head according to claim 1, wherein said cast iron contains vermicular graphite.

11. A method of providing a valve seat in a combustion chamber, of a cast-iron cylinder head, the method comprising the steps of:

providing an annular bore;

providing a nickel-based intermediate layer in said bore by, starting from a powder and/or wire, depositing the powder and/or wire by means of an energy beam from a welding source;

applying a contact layer, comprising depositing the latter, starting from a pulverulent airhardening tool steel, by means of an energy beam from a welding source on the intermediate layer; and flattening the cylinder head after application of the intermediate and contact layers to expose the intermediate layer at an end thereof directed towards the combustion chamber, wherein, prior to said flattening, said end of the intermediate layer is covered by the contact layer.

12. Method according to claim 11, wherein said valve seat is subjected only to machining treatment after said contact layer has been applied.

13. Method according to claim 11, wherein said contact layer comprises Vanadis.

14. Method according to claim 11, wherein said contact layer comprises two sublayers, which are deposited successively by means of a welding arc.

15. Method according to claim 11, wherein said deposition comprises cladding by means of an energy beam.

16. Method according to claim 11, wherein said deposition comprises PTAW cladding by means of an energy beam.

17. Method according to claim 11, wherein said contact layer is deposited from a steel in powder form and/or wire with less than 30% alloying elements of Mn, Cr, Mo, W, V and Co with a cooling rate of less than 500 seconds in the range from 800°-500° C.

18. Method according to claim 11, wherein said intermediate layer comprises a nickel-containing layer containing at least 40% nickel.

19. Cylinder head according to claim 1, wherein the intermediate layer has a thickness of between 0.2 mm and 1.2 mm.

20. Cylinder head according to claim 19, wherein the total thickness of the contact layer and the intermediate layer is between 2 mm and 3 mm.

* * * * *